US010859058B1

(12) United States Patent
Rothenbuhler

(10) Patent No.: US 10,859,058 B1
(45) Date of Patent: Dec. 8, 2020

(54) DIRECT FUEL INJECTED SPARK IGNITER FOR INTERNAL COMBUSTION ENGINES

(71) Applicant: Tom Rothenbuhler, Jacksonville, FL (US)

(72) Inventor: Tom Rothenbuhler, Jacksonville, FL (US)

( * ) Notice: Subject to any disclaimer, the term of this patent is extended or adjusted under 35 U.S.C. 154(b) by 0 days.

(21) Appl. No.: 16/776,931

(22) Filed: Jan. 30, 2020

Related U.S. Application Data

(60) Provisional application No. 62/799,344, filed on Jan. 31, 2019.

(51) Int. Cl.
*F02P 15/08* (2006.01)
*F02M 37/00* (2006.01)
*H01T 13/46* (2006.01)

(52) U.S. Cl.
CPC ..... *F02P 15/08* (2013.01); *F02M 37/0047* (2013.01); *H01T 13/467* (2013.01)

(58) Field of Classification Search
CPC ..... F02M 37/0047; H01T 13/467
See application file for complete search history.

(56) References Cited

U.S. PATENT DOCUMENTS 7,467,612 B2 12/2008 Suckewer et al.

*Primary Examiner* — Joseph L Williams
(74) *Attorney, Agent, or Firm* — GrayRobinson, P.A.; Michael J. Colitz, III

(57) ABSTRACT

The present disclosure relates to spark igniter. The igniter includes a terminal end, main body, a firing end, and a fuel connector. The fuel connector allows a supply of fuel to be delivered to the firing end of the igniter. In one embodiment, the firing end includes a central electrode positioned within an insulator and a series of peripherally located electrodes. The insulator preferably includes a polygonal shaped bore for securing the central electrode. Fuel from the fuel connector is delivered to firing end of the igniter and is dispensed from the corners of the polygonal shaped bore. Once dispensed, the fuel combines with air to form a fuel mixture. The fuel mixture is converted into a plasma by applying a high voltage to the electrodes of the firing end. The plasma then combusts the main fuel supply with an associated combustion chamber.

10 Claims, 7 Drawing Sheets

DIRECT FUEL INJECTED SPARK IGNITER FOR INTERNAL COMBUSTION ENGINES

CROSS REFERENCE TO RELATED APPLICATIONS

This application claims priority to Provisional Patent Application Ser. No. 62/799,344, filed on Jan. 31, 2019, entitled "Direct Fuel Injected Spark Igniter." The contents of this application are fully incorporated herein for all purposes.

TECHNICAL FIELD

This disclosure relates to an igniter. More particularly, the present disclosure relates to a spark igniter with fuel injection.

BACKGROUND OF THE INVENTION

Spark igniters are known in the art. These igniters are typically inserted within the combustion chamber (and when applicable into the augmentor) of an internal combustion engine. A separate fuel nozzle is likewise inserted into the combustion chamber at a location that is immediately opposite the igniter. A cone shaped fuel air/mixture is dispensed from the distal end of the fuel nozzle. The fuel nozzle may be angled with respect to the igniter to ensure the fuel/air mixture is delivered to the firing end of the igniter. The igniter then combusts the fuel/air mixture to cause a plasma event within the combustion chamber (or augmentor) of the engine. The efficiency of the igniter is a direct result of how far this plasma event can be created within the combustion chamber.

An example of a spark igniter is disclosed in U.S. Pat. No. 7,467,612 to Suckewer et. al. Suckewer discloses an ignition circuit for a high pressure internal combustion engine. A high voltage is applied to the electrodes of the igniter, with the voltage being high enough to cause a break-down to occur between the electrodes. This causes a plasma kernel to form adjacent the surface of the electrode. A "simmer" current is then applied to move the plasma kernel to a free end of the electrode.

Some types of engine hardware suffer from combustion instabilities, a phenomenon known as "screech." Screech occurs in various combustion systems and is the result of a complex physical coupling of acoustic resonances in the combustion chamber. These resonances cause fluctuations in the heat release of the combustion process. Engine hardware can be damaged as a result of corresponding pressure fluctuations. The igniter of the present disclosure seeks to combat or overcome problems associated with screech.

Although the igniters of the background art all achieve their own unique individual objectives, all suffer from drawbacks. Namely, the igniters of the background suffer from various inherent inefficiencies. Known igniters also suffer from screech. It has been discovered that many of these inefficiencies can be overcome by providing an igniter arrangement and geometry that forms the plasma event further within the interior combustion chamber. The igniter of the present disclosure is designed to overcome the various drawbacks associated with the background art.

SUMMARY OF THE INVENTION

The disclosed igniter has several important advantages over known igniter constructions.

One advantage is realized by providing electrodes that ignite the main fuel source further within the combustion chamber to realize increased efficiencies.

A further advantage is realized by utilizing a central electrode and a series of peripheral electrodes to realize greater rates of combustion.

A further advantage is realized by providing a firing end insulator with a polygonal shaped central bore.

Still yet another advantage is realized by positioning the central electrode within the polygonal bore, whereby fuel is dispensed at the corners of the polygonal bore.

Another advantage is realized by providing an igniter wherein the fuel path is located within the igniter itself.

A further advantage is realized by providing an igniter that combats problems associated with combustion instabilities.

Still yet another advantage is realized by providing an igniter that avoids screech and the corresponding damage that it causes to engine hardware.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure, reference is now made to the following descriptions, taken in conjunction with the accompanying drawings, in which.

Similar reference numerals refer to similar parts throughout the several views of the drawings.

| PARTS LIST | |
|---|---|
| 14 | Igniter System |
| 16 | Exciter |
| 18 | Ignition Leads |
| 20 | Igniter |
| 22 | Terminal End of Igniter |
| 24 | Threaded Extent of Terminal End |
| 26 | Fuel Connector |

-continued

| PARTS LIST | |
|---|---|
| 28 | Threaded Extent of Fuel Connector |
| 30 | Combustion Chamber |
| 31 | Combustion Wall |
| 33 | Outer Wall |
| 32 | Conical Distal End of Fuel Connector |
| 34 | Body of Igniter |
| 36 | Threaded Extent of Body |
| 38 | Firing End |
| 40 | Central Insulator |
| 42 | Peripheral Electrodes |
| 44 | Central Electrode |
| 46 | Bore in Insulator |
| 48 | Corners of Bore |
| 52 | Sides of Bores |
| 54 | Fuel Path |
| 58 | Central Bore |
| 62 | Channel in Central Electrode |
| 64 | Bore in Central Electrode |
| 66 | Side Port in Central Electrode |

DETAILED DESCRIPTION OF THE DRAWINGS

The present disclosure relates to spark igniter. The igniter includes a terminal end, main body, a firing end, and a fuel connector. The fuel connector allows a supply of fuel to be delivered to the firing end of the igniter. In one embodiment, the firing end includes a central electrode that is centrally positioned within an insulator. A series of peripheral electrodes are optionally positioned about the central electrode. The insulator preferably includes a polygonal shaped bore for securing the central electrode. Depending upon the application, different shaped bores can be employed. Fuel from the fuel connector is delivered to the firing end of the igniter and is dispensed from the corners of the polygonal shaped bore. Once dispensed, the fuel combines within air to form a fuel mixture. The fuel mixture is converted into a plasma by applying a high voltage to the electrodes of the firing end. The plasma is preferably formed at a distance within the combustion chamber or augmentor. The various details of the present disclosure, and the manner in which they interrelated, are described in greater detailed hereinafter.

Figure 1:
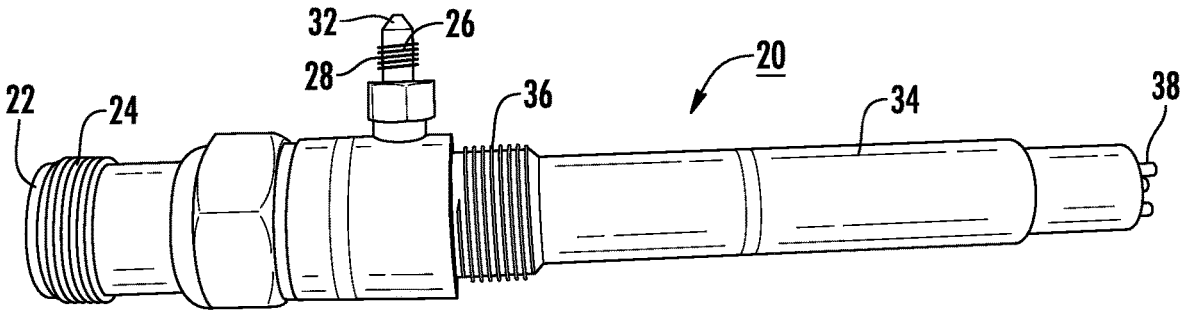
FIG. 1 is a side elevational view of the spark igniter of the present disclosure.
Figure 10:
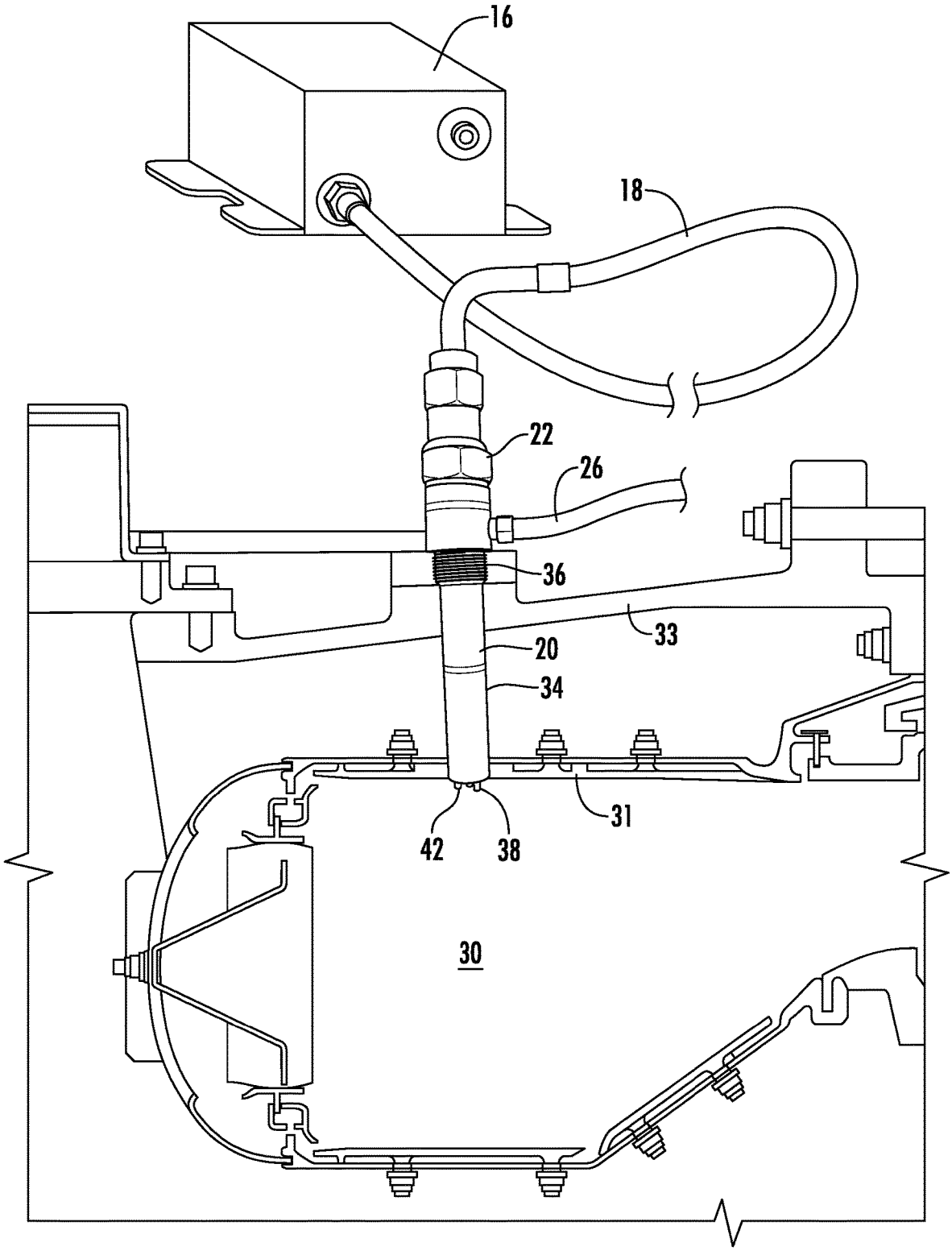
FIG. 10 illustrates the igniter in place within a combustion chamber.

FIG. 1 illustrates a preferred but non-limiting construction for igniter 20. Igniter 20 includes a terminal end 22 with an outer threaded extent 24. Threads 24 permit a cap to be fitted over the terminal end 22 of igniter 20. As illustrated in FIG. 10, terminal end 22 is adapted to be coupled to an ignition system 14. As in known in the art, ignition system 14 consists of an exciter 16, an ignition source, ignition leads 18, and an igniter plug. Ignition system 14 functions in delivering a current to the electrodes at the firing 38 of igniter 20.

Figure 2:
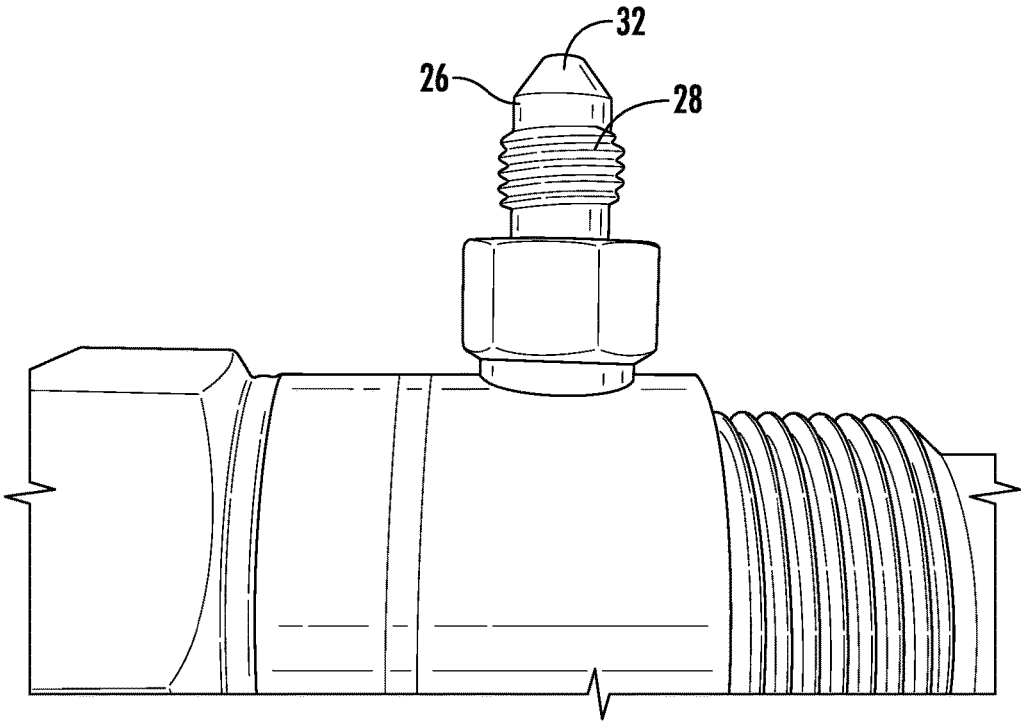
FIG. 2 is a detailed view of the fuel connector.

An intermediate extent of igniter 20 includes a fuel connector 26 for connecting igniter 20 to a fuel source via a length of tubing (FIG. 10). As depicted in FIG. 2, fuel connector 26 preferably include a threaded extent 28 and a conical distal end 32. The body 34 of igniter 20 is preferably tapered along its length such that igniter 20 can be secured through the combustion wall 31 of the combustion chamber 30 of an engine (FIG. 10), such as a gas turbine engine. In this regard, body 34 includes a threaded extent 36 that may be mated to the threaded extent of an outer wall 33 of combustion chamber 30. Such a connection would permit igniter 20 to be removed, replaced, or serviced as needed.

Figure 3:
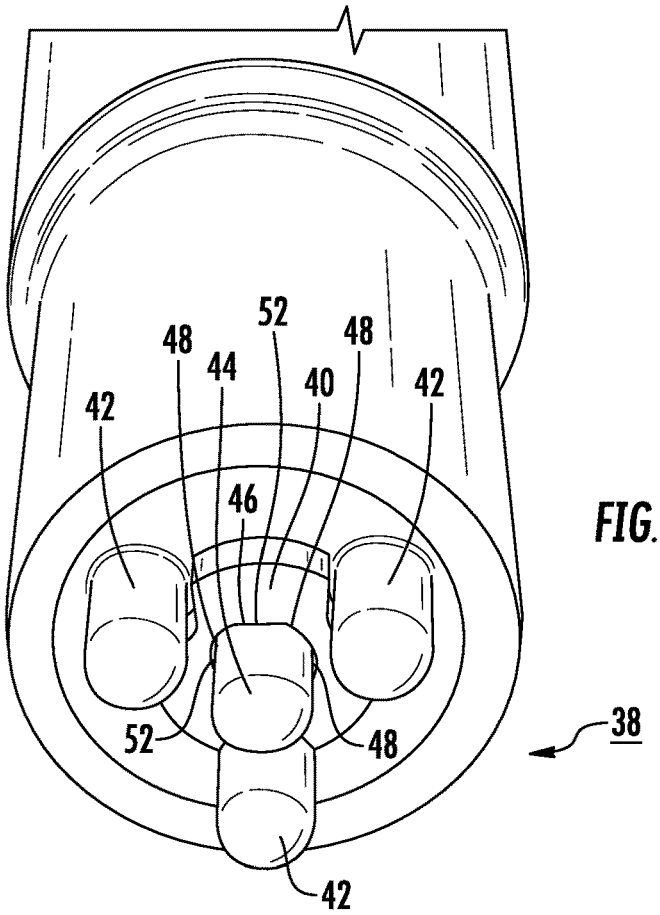
FIG. 3 is a detailed view of the firing end of the igniter.

The distal end of igniter 20 constitutes the firing end 38. Firing end 38 combines electricity from the ignition system 14 and fuel from fuel connector 26 to combust a fuel/air mixture and create a plasma event within the interior of combustion chamber 30. Although depicted for use in a combustion chamber 30, the igniter 20 can also be used in an augmentor or the afterburner of a high performance engine. The present igniter 20 improves the efficiency of this combustion by delivering the fuel through openings in the firing end 38. FIG. 3 illustrates a preferred, but non-limiting embodiment of firing end 38, wherein a central insulator 40 is positioned about a central electrode 44. A series of peripheral electrodes 42 are positioned about the central insulator 40. In the depicted embodiment, three equally spaced peripheral electrodes 42 are included, but it is within the scope of the present invention to use different numbers of peripheral electrodes at different locations about the insulator. Central insulator can be formed from, for example, an alumina ceramic. Insulator 40 functions as a dielectric and prevents arching between the adjacent electrodes.

Figure 5:
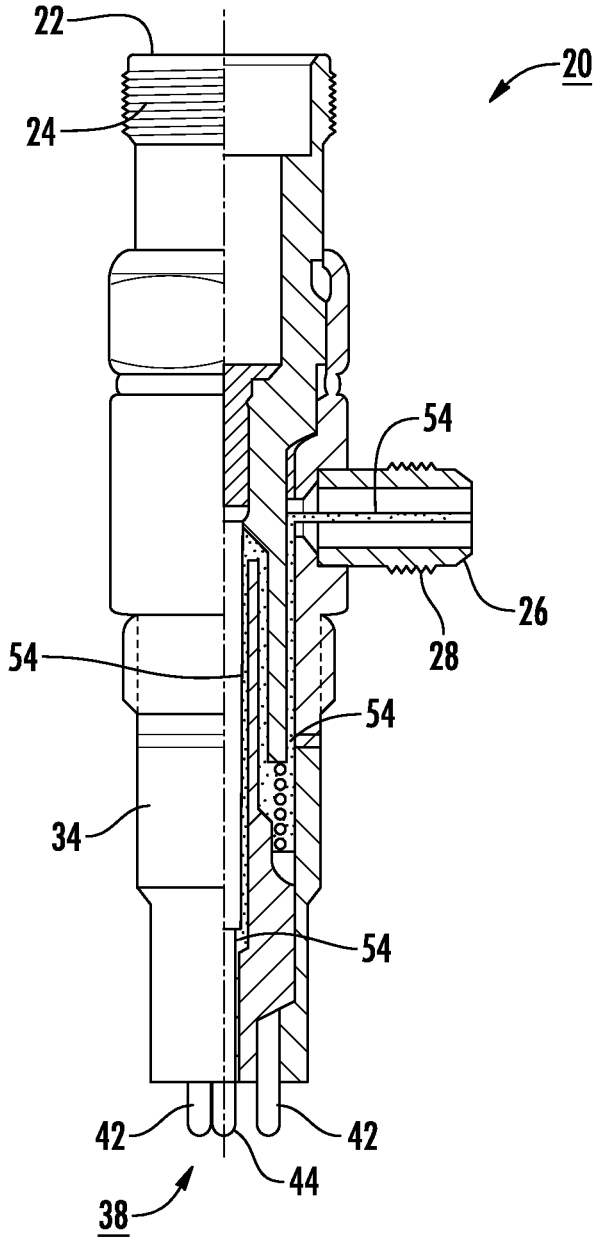
FIG. 5 is a partial sectional view of the igniter of the present disclosure.
Figure 6:
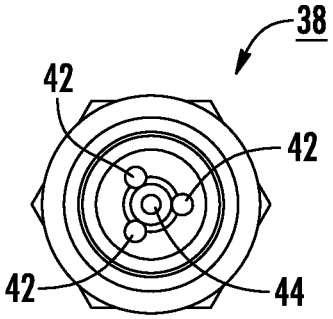
FIG. 6 is a detailed view of the firing end of the igniter.

Insulator 40 includes a bore 46 for receiving central electrode 44. Bore 46 is polygon shaped within a number of corners 48 and flat sides 52. The use of a polygonal bore allows the fuel to be dispensed from the corners 48 of the polygon. Namely, the corners 48 of polygon form gaps between the inner peripheral wall of insulator 40 and the outer surface of the central electrode 44 (FIG. 3). These gaps are connected to fuel connector 26 via a fuel path 54 (FIG. 5). These gaps act as ports through which the fuel is dispensed. At the same time, flat surfaces 52 of the polygonal bore 46 maintain a tight fight between central electrode 44 and insulator 40.

Figure 3A:
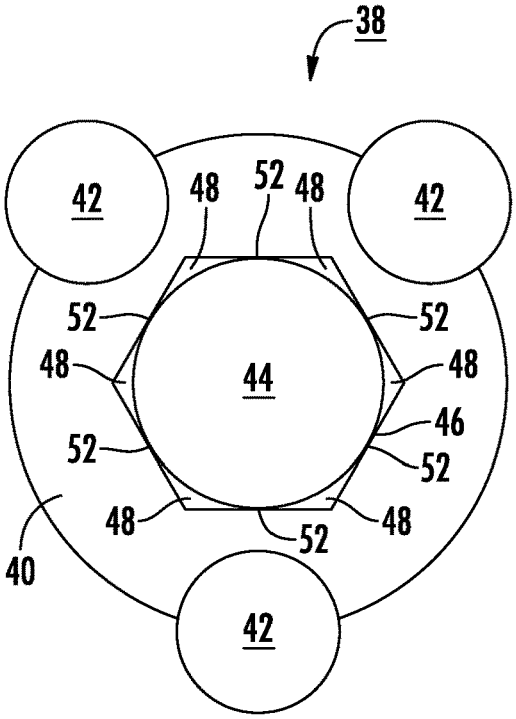
FIG. 3*a* is a plan view of a firing end with a hexagonal bore.
Figure 3B:
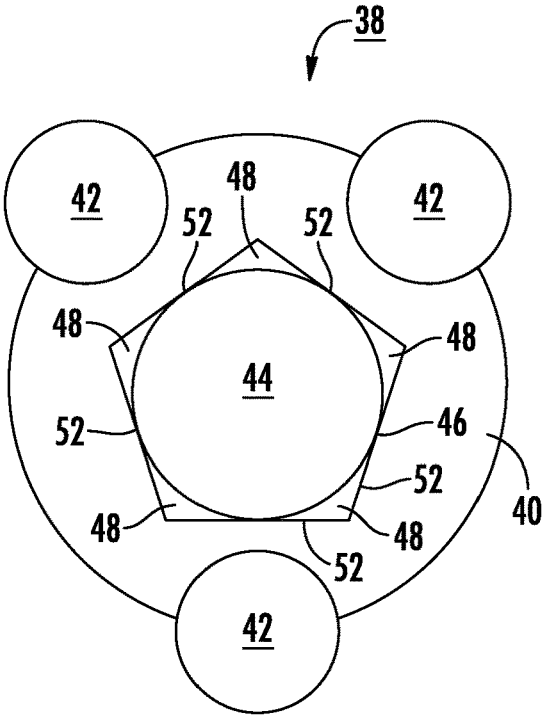
FIG. 3*b* is a plan view of a firing end with a pentagonal bore.

FIG. 3 illustrates one non-limiting example wherein insulator 40 includes a hexagonal shaped bore 46 with six flat sides 52 and six corners 48. FIG. 3*a* is a plan view of this hexagonal bore 46 and more clearly shows the six gaps 48 formed between the central electrode 44 and insulator 40. However, other shapes can be employed and the present invention is not limited to any particular bore geometry. Utilizing a polygonal bore with more sides increases the number of gaps. This, in turn, reduces the size of each gap. Alternatively, using a polygonal bore with fewer sides increases the gap size. FIG. 3*b*, for example, is a plan view of pentagonal shaped bore with five corresponding gaps 48. The particular bore geometry employed will depend upon the particular application and whether a rich or a lean fuel mixture is needed.

Figure 4:
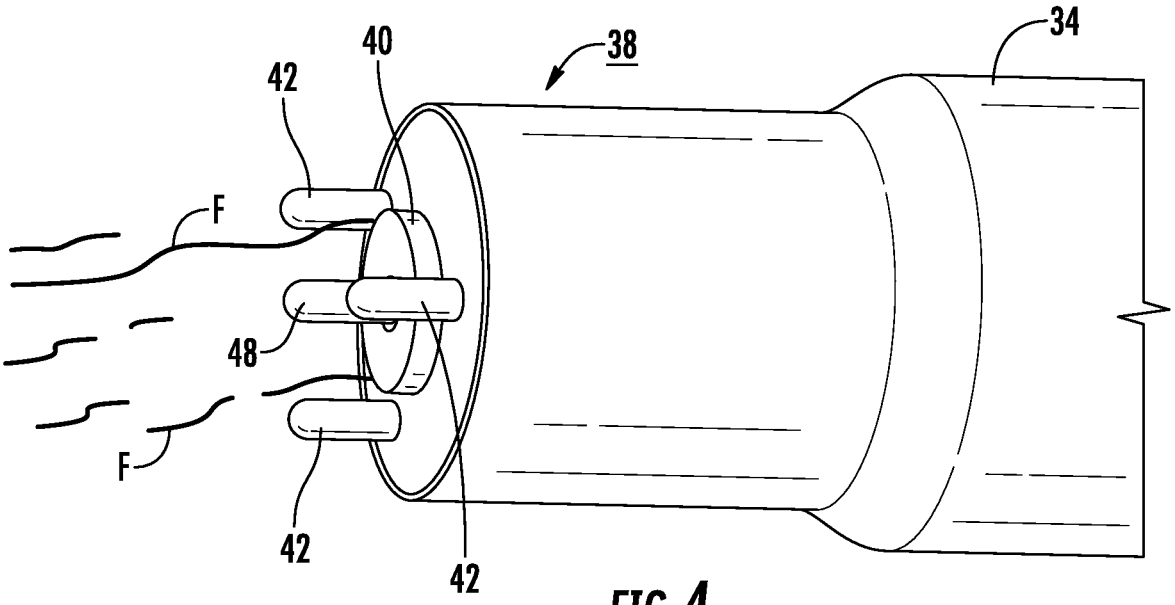
FIG. 4 is a detailed view of the firing end of the igniter.

In the embodiment of FIG. 3, one center electrode 44 and three peripheral electrodes 42 are provided. Peripheral electrodes 42 are equally spaced about center electrode 44. However, different numbers of electrodes and in different configurations can readily be used. With reference again to FIG. 3, insulator 40 may further includes arcuate cut-outs to accommodate the peripheral electrodes 42. FIG. 4 illustrates the fuel exiting firing end 38 of igniter 20 via gaps 48 and combining with air to form a fuel-air mixture "F."

A high voltage current is supplied by the ignition system 14 to the electrodes 42/44 of the firing end. The voltage is preferably sufficient to cause a breakdown between the various electrodes 42/44 of firing end 38. This, in turn, causes a high current electrical discharge to be formed over a surface of insulator 40, and ultimately, a plasma kernel is formed adjacent to firing end 38. Thereafter, a series of lower voltage pulses can be applied to electrodes 42/44.

More specifically, by pulsing the voltage at a preferred frequency, multiple plasma events are formed that are joined together after leaving the firing end 38. This, in turn, causes the plasma to be formed further within the interior of the combustion chamber; ultimately, this results in a more efficient ignition. It further eliminates screech and associated damage to engine hardware.

As noted, the problems associated with screech are the result of acoustic resonances within the combustion chamber. Engine hardware can be damaged as a result of associated pressure fluctuations. Igniter 20 helps reduce screech by creating plasma events with greater efficiency. Screech can be further reduced by maneuvering igniter 20 so that firing end 38 points towards the source of the screech. The energy produced by firing end 38 helps counteract the acoustic resonances giving rise to screech.

FIG. 5 is a partial cross sectional view showing the flow path of the fuel from connector 26 to the firing end 38. As illustrated, the path 54, which can be formed from a ceramic material, is circuitous, with a series of U-turns. Path 54 eventually exits through gaps about the central insulator 40. This represents an improvement over known igniter constructions in that the fuel path is located within the igniter 20, thereby eliminating the need for a separate fuel injector. Further efficiencies are realized by dispensing the fuel along a path that is parallel to the orientation of the electrodes 42/44.

Alternative Fuel Paths

Figure 7:
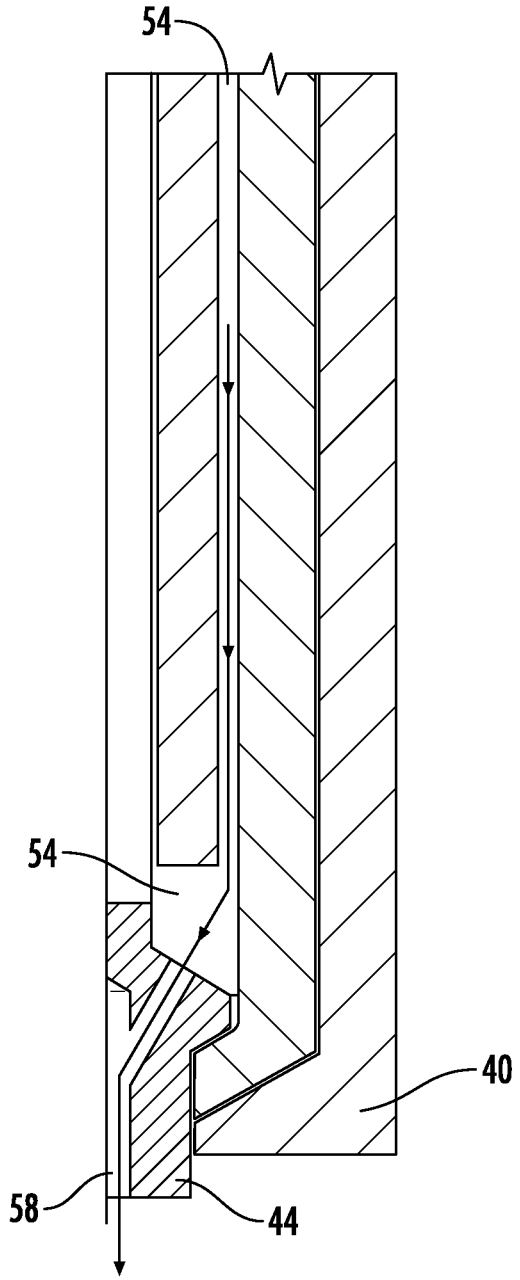
FIG. 7 is an alternative embodiment of the igniter illustrating a fuel path that extends centrally through the central electrode.
Figure 8:
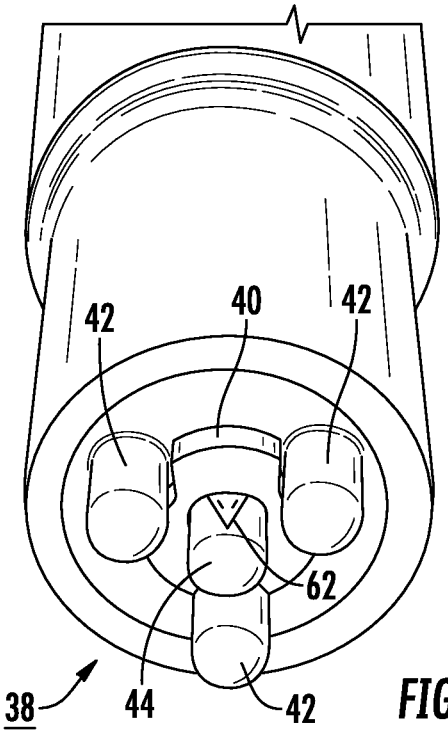
FIG. 8 is an alternative embodiment of the igniter illustrating the fuel path extending along a channel formed within the central electrode.
Figure 9:
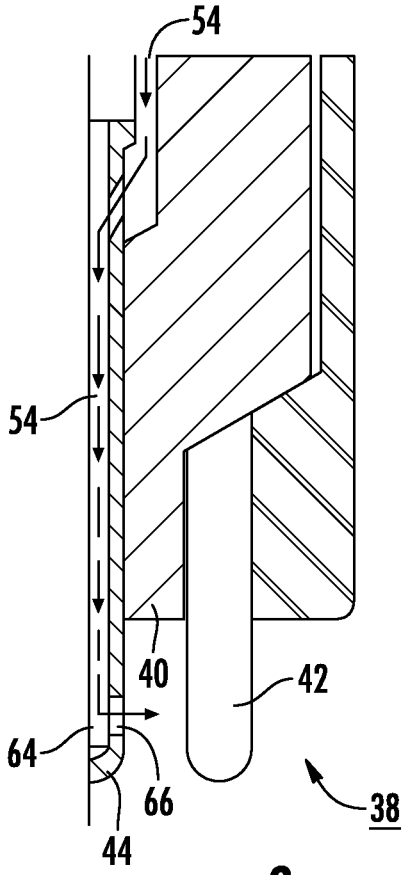
FIG. 9 is an alternative embodiment of the igniter illustrating a fuel path that extends through the central electrode and exits though an opening in the side of the electrode and dispenses fuel in a horizontal plane.

The prior embodiments describe fuel paths that terminate at gaps between the center electrode 44 and insulator 40. FIGS. 7-9 illustrate additional alternative embodiments with differing exit points for the fuel.

FIG. 7 illustrates a centrally located bore 58 within the central electrode 44. This central bore 58 is connected to fuel path 54. Fuel is routed through fuel path 54 within the main body and then dispensed through bore 58 of electrode 44, after which it is ignited. It is also possible to include a fuel atomizer at the end of the centrally located bore 58 for distributing the fuel into a fine mist.

FIG. 8 illustrates a further additional electrode embodiment. In this embodiment, the central electrode 44 includes a single channel 62 formed within its side. This side channel 62 is formed along the length of the electrode 44 and acts as a fuel path. Channel 62 may be u-shaped or v-shaped. Channel 62 connects to the fuel path 54 within igniter 20 and allows fuel to be dispensed immediately adjacent to the central axis of central electrode 44. This embodiment reduces the volume of fuel that is dispensed and is preferable for engines that run leaner.

FIG. 9 illustrates another embodiment wherein a bore 64 is centrally located within central electrode 44. However, instead of exiting through an opening in the bottom of electrode 44, a side port 66 is included. This permits the fuel to exit radially from the electrode.

In accordance with the disclosure, any number of orifices can be located in either the igniter center electrode or the igniter firing end ceramic. For example, the igniter may include a single longitudinal slot machined in a round ceramic bored firing end.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A spark igniter (20) that is interconnected to an ignition system, the spark igniter (20) positioned within a combustion chamber (30), the spark igniter (20) creating plasma events within the combustion chamber (30) with an increased efficiency, the spark igniter (20) comprising:

a cylindrical body (34) including a terminal end (22) and a firing end (38) and an intermediate extent therebetween, the body (34) being tapered adjacent the firing end (38) to facilitate the placement of the igniter (20) within the combustion chamber (30);

a fuel connector (26) formed along the intermediate extent of the cylindrical body (34), the fuel connector (26) including tapered end (32) and a threaded extent (28), the threaded extent (28) permitting the fuel connector (26) to be removably coupled to a fuel source;

an insulator (40) formed within the firing end (38), the insulator (40) including a centrally located, hexagonal bore (46), the bore (46) defining six flat sides (52) and six corners (48), the insulator (40) further including a peripheral extent with three equally spaced cut-outs;

a central electrode (44) position within the hexagonal bore (46), with the flat sides (52) contacting the central electrode (44) and gaps formed between the central electrode (44) and the six corners (48);

a circuitous fuel path (54) formed within cylindrical body (34) and extending between the fuel connector (26) and the gaps formed between the central electrode (44) and the six corners (48);

three peripheral electrodes (42) positioned within the three equally spaced cut-outs;

whereby fuel is dispensed through the gaps and is thereafter ignited by current supplied to the central electrode (44) and peripheral electrodes (42).

2. An igniter comprising:

a body including a terminal end and a firing end;

a fuel connector formed along the body, the fuel connector permitting the igniter to be couple to a fuel source;

a fuel path extending between the fuel connector and the firing end;

an insulator formed within the firing end, the insulator including a bore;

an electrode position within the bore, a series of gaps formed between the electrode and the bore, with the gaps allowing the fuel to be dispensed through the firing end of the spark igniter.

3. The igniter as described in claim 2 wherein the bore of the insulator is in form of a polygon.

4. The igniter as described in claim 3 wherein the bore of the insulator is in the form of a hexagon.

5. The igniter as described in claim 3 wherein the bore of the insulator is in the form of a pentagon.

6. The igniter as described in claim 2 wherein the fuel path includes multiple bends.

7. The igniter as described in claim 2 wherein three peripheral electrodes are positioned about the insulator.

8. The igniter as described in claim 2 wherein a series of lower voltage pulses are applied to the electrode to create a series of plasma events.

9. The igniter as described in claim 2 wherein the bore is centrally located within the insulator.

10. An igniter comprising:

a body including a terminal end and a firing end;

a fuel path extending within the body and terminating at the firing end;

an insulator formed within the firing end, the insulator including a bore;

an electrode positioned adjacent to the bore;

fuel positioned within the fuel path and being dispensed at the firing end at a location adjacent to the bore.

* * * * *